United States Patent [19]

Yamatsuta et al.

[11] 4,444,603

[45] Apr. 24, 1984

[54] ALUMINUM ALLOY REINFORCED WITH SILICA ALUMINA FIBER

[75] Inventors: Kohji Yamatsuta; Ken-ichi Nishio, both of Shiga, Japan

[73] Assignee: Sumitomo Chemical Company, Limited, Osaka, Japan

[21] Appl. No.: 413,253

[22] Filed: Aug. 31, 1982

[30] Foreign Application Priority Data

Sep. 1, 1981 [JP] Japan ..... 56-138046
Dec. 2, 1981 [JP] Japan ..... 56-194126

[51] Int. Cl.[3] ..... C22C 1/09
[52] U.S. Cl. ..... 148/127; 428/614
[58] Field of Search ..... 148/127; 428/614

[56] References Cited

FOREIGN PATENT DOCUMENTS 56-23242 3/1981 Japan ..... 428/614

*Primary Examiner*—Veronica O'Keefe
*Attorney, Agent, or Firm*—Birch, Stewart, Kolasch & Birch

[57] ABSTRACT

A process for preparing a fiber-reinforced metal composite material which comprises (1) combining an inorganic fiber comprising alumina as the main component and silica as the secondary component with an aluminum alloy containing at least one of copper, silicon, magnesium and zinc as the secondary component at a temperature of not lower than the melting point of said alloy to make a composite, (2) subjecting said composite to solid solution treatment, (3) quenching the treated composite and (4) optionally tempering the quenched composite at a temperature of from 100 to 250° C.

10 Claims, No Drawings

ALUMINUM ALLOY REINFORCED WITH SILICA ALUMINA FIBER

The present invention pertains to a method for the preparation of a fiber-reinforced metal composite material (hereinafter referred to as "FRM"). More particularly, it relates to a method for the preparation of FRM of fairly increased mechanical strength.

Recently, light-weight composite materials which comprise inorganic fibers such as alumina based fiber, carbon filter, silica fiber, silicon-carbide filter, boron fiber and a matrix such as aluminum or its alloy (hereinafter referred to as "aluminum alloy") have been developed and begun to be utilized in various kinds of industrial fields as mechanical parts which require especially heat durability and high strength in aerospace or car industry. However, FRM and its producing methods now under developed have many drawbacks. Thus, the solid phase method such as diffusion bonding which combines a solid phase aluminum alloy and an inorganic fiber can produce FRM of high strength. However, this method is hardly applicable to the industrial production of FRM, because of its higher producing cost based on its complex instruments and troublesome operations. FRM produced with the liquid phase method, which makes the composite from a molten alluminum alloy and an inorganic fiber, has an advantage of lower productive cost through its simpler operations but has unfavorable difficulties in that the molten aluminum alloy and the inorganic fiber react at their interface so as to decrease the strength of FRM lower than the level necessary for the practical use. The method proposed in Japanese Patent Application No. 134897/1977 comprises subjecting a formed product of FRM to treatment with a solid solution and quenching the thus treated product to provide FRM of remarkably enhanced mechanical properties. However, if there is a case where materials to be used for mechanical parts are often demanded to have not only a high tensile strength as well as a high flexural strength but also a high shear strength, and FRM produced by the method of the said Japanese Patent Application is insufficient in this respect.

In order to provide an economical method which can produce FRM of higher mechanical strength sufficient for the practical use, the extensive study has been carried out. As a result, it has been found that FRM of enhanced mechanical strength can be produced economically by combining an inorganic fiber of which the main component is alumina and the secondary component is silica with an aluminum alloy comprising at least one of Cu, Si, Mg and Zn at a temperature of not lower than the temperature where said aluminum alloy shows a liquid phase to make a composite, subjecting the composite to solid solution treatment and thereafter quenching the thus treated composite. It has also been found that when the composite is subjected to the solid solution treatment at a temperature of not lower than 400° C., quenched and then tempered at a temperature of from not lower than 100° C. and not higher than 250° C., FRM of high shear strength can be produced.

A main object of the present invention is to provide an economical method for the preparation of FRM of enhanced mechanical strength. Another object of the invention is to provide an economical method of combining an inorganic fiber with an aluminum alloy comprising at least one of Cu, Si, Mg or Zn. These and other objects and advantages of the invention will be apparent to those skilled in the art from the following descriptions.

The inorganic fiber is required to have a high mechanical strength. It is desirable not to react excessively with molten aluminum alloy on the contact thereto. The reaction at the interface between the fiber and the molten alloy is desired to proceed to a proper degree, thereby the mechanical strength is not deteriorated, but the transfer of stress through the interface can be attained to realize a reinforced effect sufficiently. One of the procedures to realize this is to cover the surface of the inorganic fiber with any substance so as to control the wetability or reactivity at the interface between the fiber and the matrix metal.

Examples of the inorganic fiber, there may be exemplified carbon filter, silica fiber, silicon carbide fiber, boron fiber, alumina based fiber, etc. Among them, preferred are the fiber of which the main component is alumina and the secondary component is silica (hereinafter referred to as "alumina based fiber"). Such fiber has many advantages; thus it has no doubt higher strength and, when contacted with molten aluminum alloy, the reaction takes place to a proper extent so that any material deterioration of the fiber strength is not produced and the transfer of stress through the interface between the fiber and the matrix is attained, whereby the reinforced effect can be sufficiently provided. This fiber also has a proper elasticity and therefore the breaking elongation is large; thus it shows a specific activity different from those of other fibers.

The desired content of alumina as the main component in the fiber is from not less than 50% by weight and not more than 99.5% by weight. When the alumina content is less than 50% by weight, the specific property of the alumina based fiber is affected badly and besides the reaction between the fiber and the molten aluminum alloy at the interface takes place excessively to deteriorate the fiber, by which the strength of the composite material is decreased. When the alumina content is more than 99.5% by weight, any substantial reaction between the fiber and the molten aluminum alloy does not take place and the transfer of stress can not be achieved. Because of the above mentioned reasons, the alumina based fiber is desirably a fiber which does not substantially contain $\alpha$-$Al_2O_3$. When the alumina component in the fiber contains $\alpha$-$Al_2O_3$, the fiber has a high elasticity but the grain boundary becomes fragile so that the strength of the fiber is weakened and the breaking elongation becomes smaller.

The most suitable inorganic fiber is the alumina based fiber as disclosed in Japanese Patent Publication (examined) No. 13768/1976. Such alumina fiber is obtainable by admixing a polyaluminoxane having the structural units of the formula:

$$\begin{array}{c} -Al-O- \\ | \\ Y \end{array}$$

wherein Y is at least one of an organic residue, a halogen atom and a hydroxyl group with at least one silicon-containing compound in such an amount that the silica content of the alumina fiber to be obtained becomes 28% or less, spinning the resultant mixture and subjecting the obtained precursor fiber to calcination. Particularly preferred is the alumina fiber which has a silica content of 2 to 25% by weight and which does not materially show the reflection of $\alpha$-$Al_2O_3$ in the X-ray structural analysis. The alumina fiber may contain one or more refractory compounds such as oxides of lithium, beryllium, boron, sodium, magnesium, silicon, phosphorous, potassium, calcium, titanium, chromium, manganese, yttrium, zirconium, lanthanum, tungsten and barium in such an amount that the effect of the invention is not substantially reduced.

The amount of the inorganic fiber used for FRM is not specifically restricted insofar as a strengthened effect is produced. By adopting a proper processing operation, the density of the fiber can be suitably controlled to make infiltration of the molten matrix into the fiber bundles easier.

The aluminum alloy usable in this invention may be a heat-treatable alloy of which the main component is aluminum and the secondary component is at least one of Cu, Mg, Sn and Zn. For the purpose of enhancement of the strength, fluidity, making a fine crystal structure, one or more elements chosen from Si, Fe, Cu, Ni, Sn, Mn, Pb, Mg, Zn, Zr, Ti, V, Na, Li, Sb, Sr and Cr may be contained as the third and/or further component(s). These alloys have a favorable character with which FRM can be effectively enhanced in mechanical strength such as shear strength, tensile strength and so on.

The method of this invention can be applied effectively to any process for improvement of the mechanical strength of FRM as disclosed in Japanese Patent Applications Nos. 105729/1970, 106154/1970, 52616/1971, 52617/1971, 52618/1971, 52620/1971, 52621/1971 and 52623/1971, where one or more additive elements in the matrix other than described above such as Bi, Cd, In, Ba, Ra, K, Cs, Rb or Fr are incorporated in alluminum alloys. With the incorporation of one or more of these additive elements, the tensile strength and flexural strength of FRM can be remarkably enhanced, whereby the effect of this invention can be realized clearly.

It is not necessarily clear why there is provided a prominent composite effect in the combination between the inorganic fiber comprising alumina as the main component and the aluminum alloy as above stated. However, it is inferred as follows; thus, the favorable wettability between the alumina based fiber and the matrix alloy, the morphology of the alloy in the vicinity of the interface between the fiber and the matrix, etc, probably help to realize the reinforcing effect through the solid solution treatment prominently. Besides, the large breaking elongation provides a specific behavior different from those observed in conventional FRM where the breakage of the fiber of FRM proceeds in advance, thereafter the transfer of the destruction takes place.

The aluminum alloy can contain other elements in the amount which does not damage the effect of the invention.

The conditions at the heat treatment, more precisely at the solid solution treatment, may vary according to the species of the matrix used. Generally speaking, a suitable temperature range is not higher than the temperature where the liquid phase of the alloy appears and not lower than the temperature where the segregation can diffuse; in other words, the solid dissolves into the base alloy comparatively earlier. In case of Al-Cu and Al-Zn, the preferable temperature is not lower than 400° C. and not lower than 430° C., respectively. As for the maximum temperature limit, theoretically any temperature is available so far as the formed product of FRM does not deform. However, generally speaking, it is desirable to conduct the heat treatment at a temperature lower than the solid phase line of the matrix alloy. More specifically, in case of Al-5% by weight Cu alloy, the most preferably temperature range is from 400° C. to 540° C., and in case of Al-5% by weight Mg, the range from 350° C. to 440° C. is the most preferable. The time necessary for the solid solution treatment depends on the temperature at the treatment and the size of the product. However, generally speaking, the most preferable time is about 1 hour to 30 hours.

The quenching is conducted at the speed which is enough short not to allow the segregation once diffused into the base alloy to reprecipitate in a coarse precipitant. Specifically speaking, quenching can be conducted at a rate not less than 300° C./min from the temperature of the solid solution treatment to 200° C. As for the quenching method generally adopted, there are exemplified some methods such as cooling in water or oil, immersing in liquid nitrogen or air-cooling. For the purpose of strain releasing, etc., a tempering operation after the quenching can be applied so far as it does not damage the reinforcing effect of this invention. Realistically, it is desirable to conduct the tempering at a temperature of not less than 100° C. and not more than 250° C. for a period of not less than 5 hours and not more than 30 hours.

With the application of solid solution treatment and quenching as described above, not only the matrix alloy itself can be naturally strengthened through solid dissolving of segregation once existed at the interface of the grain boundary into the $\alpha$-phase but also the mechanical strength of FRM can be enhanced to from several times to several decades of the value estimated from the strength enhancement of the matrix alloy itself. This is inferred from the fact that some change or the like at the interface between the inorganic fiber and the matrix derived from the solid solution treatment and quenching contributes to the enhancement of the mechanical strength of FRM.

The preparation of the composite material of the invention may be effected by various procedures such as liquid phase methods (e.g. liquid-metal infiltration method), solid phase methods (e.g. diffusion bonding), powdery metallurgy methods (sintering, welding), precipitation methods (e.g. melt spraying, electrodeposition, evaporation), plastic processing methods (e.g. extrusion, compression rolling) and squeeze casting methods in which the melted metal is directly contacted with the fiber. A sufficient effect can be also obtained in other procedures as mentioned above.

The thus prepared composite material shows a remarkably enhanced mechanical strength such as tensile strength, flexural strength or shear strength in comparison with the system not conducted heat treatment of the invention. It is an extremely valuable merit of the invention in terms of commerical production that the processing of this FRM can be realized in a conventional manner by the utilization of usual equipments without any alteration.

The present invention will be hereinafter explained further in detail by the following examples which are not intended to limit the scope of the invention. Each % mark in the examples represents % by weight with the exception of specific remark.

EXAMPLE 1

In a mold having an internal diameter of 10 mm and a length of 100 mm made of stainless steel, alumina based fiber having an average fiber diameter of 14 m, a tensile strength of 150 kg/mm$^2$ and a Young's modulus of elasticity of 23,500 kg/mm$^2$ ($Al_2O_3$ content, 85%; $SiO_2$ content, 15%) was filled up so as the fiber volume content (Vf) to be 50%. On the other hand, 2024 aluminum alloy (Al-4.5% Cu-0.6% Mn-1.5% Mg) and 6061 aluminum alloy (Al-0.6% Si-0.25% Cu-1.0% Mg-0.20% Cr) were respectively introduced into a crucible made of graphite and melted under heating up to 700° C. Then, one end of the mold filled with the alumina fiber was immersed in the molten alloy. While the other end of the tube was degassed in vacuum, a pressure of 50 kg/cm$^2$ was applied onto the surface of the molten alloy, whereby the molten alloy was infiltrated into the fiber bundles to provide a composite material. This composite material was cooled slowly to room temperature. The formed materials of FRM were released from the mold (hereinafter referred to as "F material"). Some parts of this formed materials were subjected to the solid solution treatment in the furnace at a temperature of 515° C. for 10 hours and then introduced into water to be quenched. The thus obtained formed materials were subjected to determination of flexural strength. The results are shown in Table 1. It was observed that remarkable enhancement of flexural strength can be attained by the solid solution treatment of this invention.

TABLE 1

| Matrix | Condition of heat treatment | Flexural strength (kg/cm$^2$) |
|---|---|---|
| 2024 Alloy | None (as it is F material) | 45 |
| | 515° C. × 10 hours (solid solution treatment), then quenching in water. | 92 |
| 6061 Alloy | None (as it is F material) | 50 |
| | 515° C. × 10 hours (solid solution treatment), then quenching in water. | 85 |

posite material. Half parts of these FRM were subjected to the solid solution treatment in a furnace of 500° C. for 12 hours and then introduced to water to be quenched.

Samples of 2 mm×10 mm×100 mm for flexural strength test were cut off from these FRM and tested. The results are shown in Table 2. An enhancement of the strength was observed to be attained by the solid solution treatment of this invention.

TABLE 2

| Matrix | Condition of heat treatment | Flexural strength (kg/cm$^2$) |
|---|---|---|
| ADC-12 | None (as it is F material) | 55 |
| | 500° C. × 12 hours (solid solution treatment), then quenching in water. | 89 |

EXAMPLE 3

FRM having Vf of 50% was prepared by combining alumina based fibers as used in Example 1 with matrix metal AU5GT (Al-4.2% Cu-0.36% Si-0.23% Mg-0.10% Ti-0.01% Zn-0.001% B) and AA-7076 (Al-7.5% Zn-0.6% Cu-0.5% Mn-1.6% Mg) by the liquid infiltration method at a molten matrix temperature of 680° C. under a pressure of 50 kg/mm$^2$. The thus prepared FRM was subjected to the heat treatment as shown in Table 3.

FRM was prepared just as in the same condition described as above with the exception of employing aluminum of purity 99.5% and Al-7.5% Mg as the matrix metal and also subjected to the heat treatment as shown in Table 3 for comparison.

Thereafter these formed products of FRM were subjected to determination of shear strength. The results are shown in Table 3. It is recognized that thus heat treated FRM of which the matrix alloy contains Cu or Zn as the secondary component has remarkably high shear strength.

TABLE 3

| No. | Matrix alloy | Condition of heat treatment, etc. | Shear strength (kg/mm$^2$) |
|---|---|---|---|
| Example 3-1 | AU5GT | 515° C. × 10 hrs (H.T.) (W.Q.) 160° C. × 10 hrs (Tempering) | 40.2 |
| Example 3-2 | AA-7076 | 490° C. × 8 hrs (H.T.) (W.Q.) 120° C. × 22 hrs (Tempering) | 44.7 |
| Control 3-1 | AU5GT | None | 24.1 |
| Control 3-2 | AU5GT | 515° C. × 10 hrs (H.T.) (W.Q.) | 26.8 |
| Control 3-3 | AA-7076 | None | 22.5 |
| Control 3-4 | AA-7076 | 490° C. × 8 hrs (H.T.) (W.Q.) | 25.0 |
| Control 3-5 | 99.5% Al | None | 17.6 |
| Control 3-6 | 99.5% Al | 520° C. × 10 hrs. (H.T.) (W.Q.) 180° C. × 10 hrs (Tempering) | 18.0 |
| Control 3-7 | Al-7.5% Mg | None | 20.3 |
| Control 3-8 | Al-7.5% Mg | 430° C. × 18 hrs (H.T.) (W.Q.) 140° C.× 10 hrs (Tempering) | 22.7 |

Remarks:
H.T. = Solid solution treatment
W.Q. = Water quenching

EXAMPLE 2

Alumina based fibers as used in Example 1 were formed with a sizing agent into a shape of 20 mm×50 mm×100 mm and Vf of 35%. This formed product was introduced into the mold of a squeeze casting machine. The mold was heated up to 400° C. to remove the sizing agent. A definite amount of molten aluminum alloy ADC-12 heated at 800° C. was introduced into the mold, and a pressure of 1,000 kg/cm$^2$ was applied to infiltrate molten alloy into the fiber to provide a com-

EXAMPLE 4

Matrix alloy were prepared by adding Ba in the amount of 0.3% to AU5GT and AA-7076. FRM having Vf of 50% was prepared by combining the thus prepared matrix alloys and alumina based fibers as used in Example 1 just as in the same manner as Example 1. The thus prepared formed products of FRM were subjected to the heat treatment and thereafter determination of shear strength and flexural strength. The results are shown in Table 4. It is recognized that FRM of remarkably enhanced flexural strength and balanced flexural stength with shear stength can be prepared with employment of matrix alloy containing small amount of Ba and the heat treatment of FRM.

TABLE 4

| No. | Matrix alloy | Condition of heat treatment, etc. | Shear strength (kg/mm²) | Flexural strength (kg/mm²) |
|---|---|---|---|---|
| Control 4-1 | AU5GT-0.3% Ba | None | 26.7 | 110 |
| Control 4-2 | AU5GT-0.3% Ba | 515° C. × 10 hrs (H.T.) (W.Q.) | 28.2 | 105 |
| Example 4-1 | AU5GT-0.3% Ba | 515° C. × 10 hrs (H.T.) (W.Q.) 160° C. × 10 hrs (Tempering) | 44.3 | 107 |
| Control 4-3 | AA-7076-0.3% Ba | None | 23.6 | 136 |
| Control 4-4 | AA-7076-0.3% Ba | 490° C. × 8 hrs (H.T.) (W.Q.) | 24.6 | 138 |
| Example 4-2 | AA-7076-0.3% Ba | 490° C. × 8 hrs (H.T.) (W.Q.) 120° C. × 22 hrs (Tempering) | 46.4 | 140 |
| Control 4-5 | AA-7076-0.3% Ba | 300° C. × 8 hrs (H.T.) (W.Q.) 120° C. × 10 hrs (Tempering) | 24.1 | 132 |

EXAMPLES 5 and 6

FRM having Vf of 50% were prepared by combining carbon fiber having an average fiber diameter of 7.5 μm, a tensile strength of 300 kg/mm² or silicon fiber having an average fiber diameter of 15 μm, a tensile strength of 220 kg/mm² and a Young's modulus of elastricity of 20,000 kg/mm² respectively with AU5GT-0.3% Ba or Al-0.3% Ba alloy (both are aluminum alloy, the latter is used in terms of comparison) just as in the same manner as shown Example 3. The thus prepared formed products of FRM were subjected to solid solution treatment at 515° C. during 10 hours, then thrown into water to be quenched, thereafter tempered at 160° C. during 10 hours. These formed products were subjected to the determination of shear strength and flexural strength and the results are shown in Table 5. Formed products without solid solution treatment were also subjected to the determination of shear strength and flexural strength and the results are also shown in Table 5. It is recognized from these results that FRM prepared in the method of this invention has a superior efficiencies in both of shear strength and flexural strength.

TABLE 5

| No. | Inorganic fiber | Matrix metal | Solid solution treatment | Shear strength (kg/mm²) | Flexural strength (kg/mm²) |
|---|---|---|---|---|---|
| Example 5 | Carbon fiber | AU5GT-0.3% Ba | None | 33.8 | 55.5 |
| Control 5-1 | Carbon fiber | AU5GT-0.3% Ba | Treated | 18.4 | 52.8 |
| Control 5-2 | Carbon fiber | Al-0.3% Ba | Treated | 15.1 | 54.6 |
| Control 5-3 | Carbon fiber | Al-0.3% Ba | None | 14.3 | 56.4 |
| Example 6 | Silicon carbide fiber | AU5GT-0.3% Ba | Treated | 35.6 | 65.8 |
| Control 6-1 | Silicon 0.3% Ba | AU5GT-0.3% Ba | None | 19.3 | 64.0 |
| Control 6-2 | Silicon carbide fiber | Al-0.3% Ba | Treated | 17.5 | 62.1 |
| Control 6-3 | Silicon carbide fiber | Al-0.3% Ba | None | 16.7 | 63.2 |

What is claimed is:

1. A process for preparing a fiber-reinforced metal composite material of high mechanical strength which comprises (1) combining an inorganic fiber comprising alumina as the main component and silica as the secondary component with an aluminum alloy containing a metal selected from the group consisting of copper, silicon, magnesium, zinc and mixtures thereof at a temperature of not lower than the melting point of said alloy to make a composite, (2) retaining the composite at a temperature of not lower than 400° C. and lower than the solid phase line of the aluminum alloy for a period of about 1 to 30 hours and (3) cooling the thus treated composite at a rate of 300° C./min or more to 200° C.

2. A process according to claim 1, wherein the inorganic fiber comprises 50 to 99.5% by weight of alumina.

3. A process according to claim 2, wherein the inorganic fiber comprises not more than 28% by weight of silica.

4. A process according to claim 3, wherein inorganic fiber comprises 2 to 25% by weight of silica and 75 to 98% by weight of alumina.

5. A process according to claim 2, wherein the fiber comprises substantially no β-alumina.

6. A process according to claim 1, followed by tempering the cooled composite at a temperature of from 100 to 250° C.

7. A process for producing a fiber-reinforced metal composite of improved flexural strength, tensile strength and shear strength which comprises retaining a composite comprising an aluminum alloy containing a metal selected from the group consisting of copper, silicon, magnesium, zinc and mixtures thereof, being capable of heat treatment and an alumina fiber containing silica at a temperature above 400° C., cooling the treated composite and tempering the cooled composite at a temperature between 100 and 250° C.

8. A fiber-reinforced metal composite produced by the process of any of claim 1, 2, 3, 4, 5, or 7.

9. A fiber-reinforced metal composite produced by the process of claim 6.

10. The process of claim 1 wherein the surface of the inorganic fiber is covered with a substance to control the wettability and reactivity at the interface between the fiber and the matrix aluminum alloy.

* * * * *

UNITED STATES PATENT AND TRADEMARK OFFICE

CERTIFICATE OF CORRECTION

PATENT NO. : 4,444,603

DATED : April 24, 1984

INVENTOR(S) : Kohji Yamatsuta et al

It is certified that error appears in the above-identified patent and that said Letters Patent are hereby corrected as shown below:

In Column 1 line 12 change "filter" to --fiber--. In Column 2 line 16 change "filter" to --fiber--. In Column 3 line 17 change "Sn" to --Si--. In Column 5 line 1 change "14 m" to --14 μm--. In Column 7 line 25 change "silicon fiber" to --silicon carbide fiber--. In table 5 change inorganic fiber "carbon fiber" to --silicon carbide fiber--. In table 5 change the solid solution treatment in example 5 "None" to --Treated--. In table 5 change solid solution treatment in example 5-1 "Treated" to --None--. In Claim 5 line 2 change "β-alumina" to --α-alumina--.

Signed and Sealed this

*Twenty-eighth* Day of *May 1985*

[SEAL]

*Attest:*

DONALD J. QUIGG

*Attesting Officer* *Acting Commissioner of Patents and Trademarks*